US008985526B2

(12) United States Patent
Brushwood

(10) Patent No.: US 8,985,526 B2
(45) Date of Patent: Mar. 24, 2015

(54) SWIVEL POINT CONNECTOR FOR RAILROAD SWITCHES

(75) Inventor: Daniel H. Brushwood, Easley, SC (US)

(73) Assignee: Ansaldo STS USA, Inc., Pittsburgh, PA (US)

( * ) Notice: Subject to any disclaimer, the term of this patent is extended or adjusted under 35 U.S.C. 154(b) by 230 days.

(21) Appl. No.: 13/440,018

(22) Filed: Apr. 5, 2012

(65) Prior Publication Data

US 2013/0264432 A1 Oct. 10, 2013

(51) Int. Cl.

| | |
|---|---|
| ***E01B 7/00*** | (2006.01) |
| ***B61L 5/10*** | (2006.01) |
| ***B61L 5/06*** | (2006.01) |

(52) U.S. Cl.

CPC *B61L 5/107* (2013.01); *B61L 5/065* (2013.01)
USPC ..... 246/430

(58) Field of Classification Search

CPC ..... B61L 11/00; B61L 11/02; B61L 11/04; E01B 7/00; E01B 7/02; E01B 7/04; E01B 7/20
USPC ..... 246/264, 415 R, 430, 435 R, 438
See application file for complete search history.

(56) References Cited

U.S. PATENT DOCUMENTS

| | | | | |
|---|---|---|---|---|
| 2,009,269 | A | 7/1935 | Lundy | |
| 2,046,568 | A | 7/1936 | Lundy | |
| 2,706,772 | A | 4/1955 | Mock | |
| 2,712,914 | A | 7/1955 | Lavarack et al. | |
| 2,793,272 | A | 5/1957 | Mock | |
| 3,527,936 | A | 9/1970 | Abendroth | |
| 3,679,895 | A | 7/1972 | Paulve | |
| 4,921,189 | A | 5/1990 | Callegari | |
| 5,292,091 | A * | 3/1994 | Callegari et al. | 246/258 |
| 5,620,156 | A * | 4/1997 | Berggren et al. | 246/221 |
| 5,730,395 | A * | 3/1998 | Carmes | 246/448 |
| 6,325,334 | B1 | 12/2001 | Achleitner et al. | |
| 6,585,194 | B1 | 7/2003 | Brushwood | |
| 6,648,276 | B1 * | 11/2003 | McQuistian | 246/452 |
| 6,688,560 | B2 * | 2/2004 | Click et al. | 246/452 |
| 7,135,648 | B2 | 11/2006 | Schnedl et al. | |
| 2009/0045298 | A1 | 2/2009 | Biagiotti | |

* cited by examiner

*Primary Examiner* — R. J. McCarry, Jr.
(74) *Attorney, Agent, or Firm* — Eckert Seamans Cherin & Mellot, LLC; Stephen A. Bucchianeri

(57) ABSTRACT

A mechanism for coupling a switch point to a point detector box having a point detector bar includes a first portion structured to be slidably coupled to the point detector bar and a second portion structured to be slidably coupled to the switch point.

16 Claims, 3 Drawing Sheets

SWIVEL POINT CONNECTOR FOR RAILROAD SWITCHES

BACKGROUND OF THE INVENTION

1. Field of the Invention

The present invention relates generally to railway monitoring apparatus and, more particularly to a coupling mechanism for coupling railway apparatus to a railway. The present invention also relates to detection and railway switching systems employing such coupling mechanism.

2. Description of the Prior Art

Numerous different types of railroad switching equipment are known and understood in the railroad arts. It is generally understood that a railroad switch apparatus is employed to switch a train from a first set of railroad tracks onto a second set of railroad tracks. Such a railroad switch apparatus typically includes a pair of movable rails, a switch machine for moving the rails, a detection device for detecting the position of the rails, and assorted connective hardware that extends between the movable rails, the switch machine, and the detection device for various purposes. The switch machine provides the forces necessary to move the movable rails between a first position and a second position and to lock the movable rails in the first and second positions. The detection device monitors the position of the movable rails.

It is also known that railroad equipment including railroad switch apparatuses are typically subjected to extreme punishment and distortions due to the substantial forces and vibrations transmitted from passing railroad trains, as well as severe environmental conditions including heat, snow, and ice which can greatly distort and wear components. Railroad equipment thus is preferably designed and configured generally to resist the effects of such harsh conditions, and to perform reliably under such conditions.

It is further known that railroad tracks and other related equipment extend across many remote regions, commonly referred to as "dark territory", and that trains commonly travel on such remote tracks at all hours of the day and night. As such, railroad personnel must be available to inspect and, if necessary, repair railroad equipment at numerous remote locations at any hour. As the skill level of railroad maintenance personnel varies greatly, railroad equipment is preferably of a relatively simple configuration that can be repaired with a minimal number of tools in order to limit the number of potential points of failure of such railroad equipment and to facilitate repair by virtually any railroad personnel no matter the skill level or the quantity of tools available to such personnel.

In order to ensure the proper functioning of railroad switch apparatuses in all types of weather conditions and to resist breakage and maladjustment of such switch apparatuses, the connective hardware that extends between a switch machine and a pair of movable rails has typically included connecting rods that have been substantially rigidly connected with function rods that are part of the switch machine and that are movable with respect to other parts of the switch machine. While such rigid connections generally enhance the reliability of railroad switch apparatuses, such rigid connections nevertheless increase the difficulty and expense of installing and maintaining railroad equipment due to the degree of alignment that must be attained between the switch machine and the movable tracks.

During installation and replacement of conventional railroad switch apparatuses, special care is required to align the switch machine with the movable tracks in order to ensure that the connective hardware that is rigidly connected between the switch machine and the movable tracks is properly connected, and that such connective hardware operates properly without the components thereof or the movable tracks binding during operation. Commonly, such conventional switch machines are mounted a distance from the rails of the railroad, typically on the wooden ties to which the rails were mounted or on cement pads near the wooden ties, with the base of the switch machine needing to be aligned either flush with the lower surfaces of the tracks or at a given vertical distance from such lower surfaces. Such alignment typically is burdensome and costly to achieve during initial construction, and is particularly difficult and time consuming after repair or replacement of a switch machine due to the gradual deterioration of railroad ties and the difficulty of reliably employing such ties to align a switch machine with railroad tracks.

Accordingly, there is room for improvement in structures that facilitate installation of a switch machine and connection thereof with the movable tracks of a railroad switch apparatus while providing the necessary reliability and resistance to the effects of environmental conditions in which the switch apparatus is employed.

SUMMARY OF THE INVENTION

Embodiments of the present invention improve upon known designs by providing a mechanism for coupling a switch point to a point detector box, a detection system for detecting the position of a movable switch point of a railway, and a railway switching system.

In one example embodiment, a mechanism for coupling a switch point to a point detector box having a point detector bar is provided. The coupling mechanism comprises a first portion structured to be slidably coupled to the point detector bar and a second portion structured to be slidably coupled to the switch point.

The first portion may be structured to slide along a first axis and the second portion may be structured to slide along a second axis, the second axis being oriented generally perpendicular to the first axis.

The point detector bar may move relative to the point detector box generally along a third axis, the third axis being oriented generally perpendicular to the first axis.

The first and second portions may be portions of a generally cylindrical body disposed about a central longitudinal axis and the longitudinal axis may coincide with the first axis.

The first portion may comprise a generally smooth cylindrical shaft portion structured to slidably engage a generally spherical ball member disposed within a socket coupled to the point detector bar.

The second portion may comprise an engagement portion of a first diameter bounded by an adjacent portion having a greater diameter and wherein the second portion is structured to slidably engage an elongated aperture disposed on, in or coupled to the switch point.

The first portion may be disposed at or about a first end of a generally cylindrical body and the second portion may be disposed at or about a second end of the generally cylindrical body.

In another example embodiment, a detection system for detecting the position of a movable switch point of a railway is provided. The detection system comprises a point detector box having a point detector bar and a mechanism structured to couple the point detector bar to the movable switch point. The mechanism comprises a first portion slidably coupled to the point detector bar and a second portion structured to be slidably coupled to the movable switch point.

The first portion of the mechanism may be structured to slide along a first axis and the second portion of the mechanism may be structured to slide along a second axis, the second axis being oriented generally perpendicular to the first axis.

The point detector bar may move relative to the point detector box generally along a third axis and the third axis may be oriented generally perpendicular to the first axis.

The first and second portions of the mechanism may be portions of a generally cylindrical body disposed about a central longitudinal axis and the central longitudinal axis may coincide with the first axis.

The point detector bar may comprise a socket having a generally spherical ball member disposed therein and the first portion of the mechanism may comprise a generally smooth cylindrical shaft portion slidably coupled to the ball member.

The second portion of the mechanism may comprise an engagement portion of a first diameter bounded by an adjacent portion having a second diameter greater than the first diameter. The second portion of the mechanism may be structured to slidably engage an elongated aperture disposed on, in, or coupled to the switch point.

The first portion of the mechanism may be disposed at or about a first end of a generally cylindrical body and the second portion of the mechanism may be disposed at or about a second end of the generally cylindrical body.

In a further example embodiment, a railway switching system is provided. The railway switching system comprises a movable switch point and a detection system. The detection system comprises a point detector box having a point detector bar and a mechanism coupling the point detector bar of the point detector box to the movable switch point. The mechanism comprises a first portion slidably coupled to the point detector bar and a second portion slidably coupled to the movable switch point.

The first portion of the mechanism may be structured to slide along a first axis and the second portion of the mechanism may be structured to slide along a second axis, the second axis being oriented generally perpendicular to the first axis.

The point detector bar may move relative to the point detector box generally along a third axis and the third axis may be oriented generally perpendicular to the first axis.

The first and second portions of the mechanism may be portions of a generally cylindrical body disposed about a central longitudinal axis and the central longitudinal axis may coincide with the first axis.

The point detector bar may comprise a socket having a generally spherical ball member disposed therein and the first portion of the mechanism may comprise a generally smooth cylindrical shaft portion slidably coupled to ball member.

The second portion of the mechanism may comprise an engagement portion having a first diameter bounded by an adjacent portion having a second diameter greater than the first diameter and the second portion of the mechanism may slidably engage an elongated aperture disposed on, in, or coupled to the switch point.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly. Identical parts are provided with the same reference number in all figures.

As employed herein, the term "number" shall mean one or an integer greater than one (i.e., a plurality).

Figure 1:
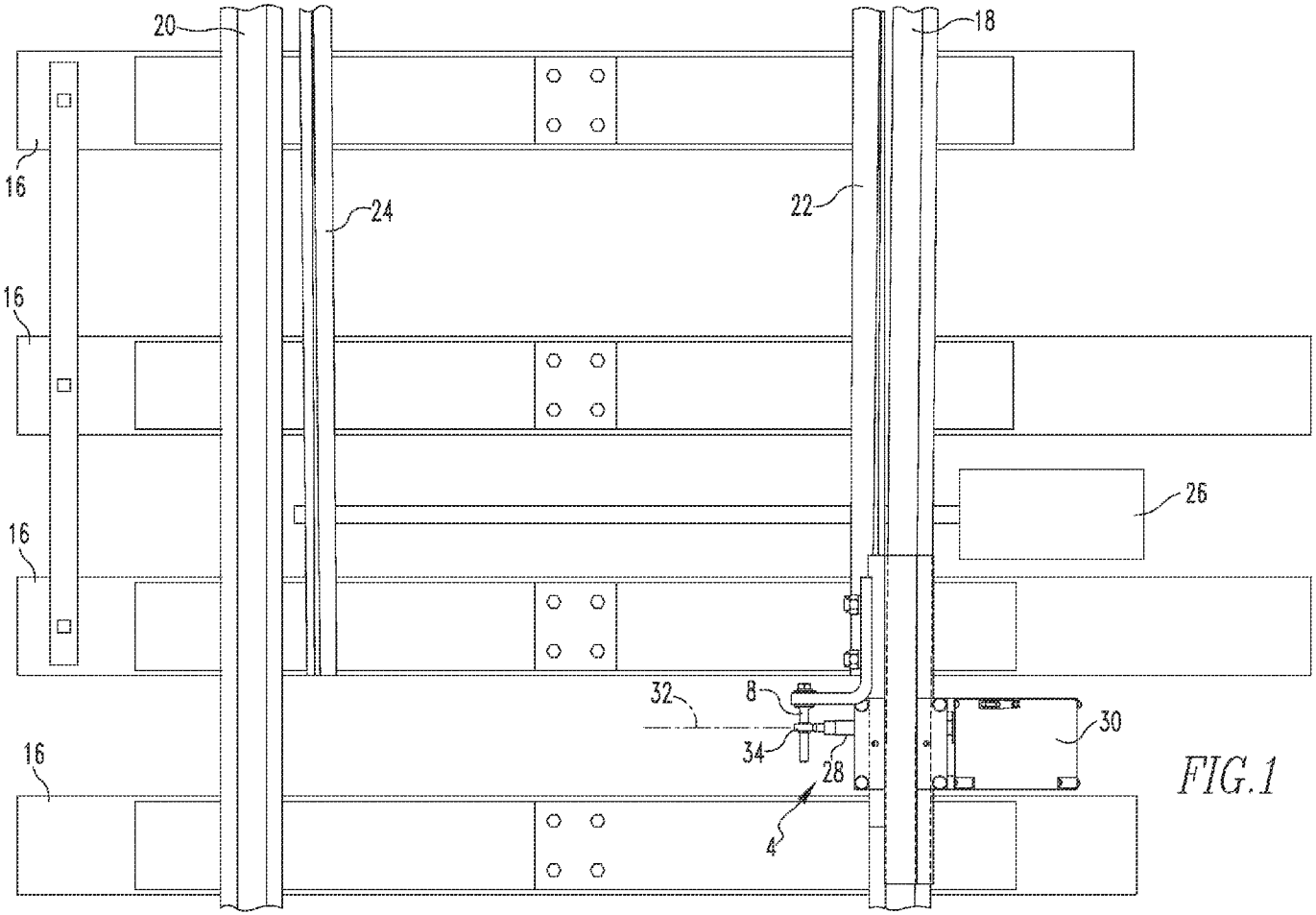
FIG. 1 is a plan view of a portion of a railroad including a railroad switch detection system in accordance with a non-limiting embodiment of the present invention.

A railroad switch detection system 4 in accordance with the present invention is indicated generally in the plan view of FIG. 1. As will be set forth more fully below, the railroad switch detection system 4 advantageously includes a coupling mechanism 8 in accordance with the present invention. As will be better appreciated from the description herein, the inclusion of the coupling mechanism 8 into the railroad switch detection system 4 facilitates the initial assembly and installation as well as the operation, maintenance and repair of the railroad switch detection system 4.

As shown in FIG. 1, the railroad switch detection system 4 is employed in conjunction with a portion of a railroad track that is depicted as including a plurality of ties 16 and a pair stock rails 18 and 20 that are fixedly mounted on the ties 16. It is understood that an additional pair of stationary stock rails (not shown) extend generally away from the railroad switch detection system 4 in addition to the stock rails 18 and 20.

The railroad switch detection system 4 includes a pair of movable rails 22 and 24 which are movable between a first position (FIG. 1) in which the movable rail 22 is engaged with the stock rail 18 and a second position (not shown) in which the movable rail 24 is engaged with the stock rail 20. Such alternate engagement of the movable rails 22 and 24 with the stock rails 18 and 20, respectively, according to operation of a switching apparatus 26 coupled with the movable rails 22 and 24 permits a train to be switched from one set of tracks onto a second set of tracks according to known principles. Due to their switching function, movable rails 22 and 24 may commonly be referred as switch points. Switching apparatus 26 may comprise a manually operated or automated switching mechanism as known in the art without varying from the scope of the present invention. Movable rails 22 and 24 are also operatively connected with a point detector bar 28 of a point detector box 30 via coupling mechanism 8, as discussed in further detail below.

Point detector box 30 may comprise one or more sensor devices suitable for detecting the movement and or relative positioning of point detector bar 28, which is movably coupled to point detector box 30. As shown in FIG. 1, point detector box 30 may be mounted directly to stock rail 18 or may be mounted a distance from rail 18, such as, for example, on or near one or more of the plurality of ties 16. In the embodiment shown in FIG. 1, point detector bar 28 is generally movable (slidably coupled) along an axis 32. It is to be appreciated that other arrangements of point detector bars and detector boxes may be employed without varying from the scope of the present invention. Point detector bar 28 preferably includes an adjustable eye-bolt or ball and socket joint 34 (discussed in detail below) disposed on an end thereof.

Figure 2:
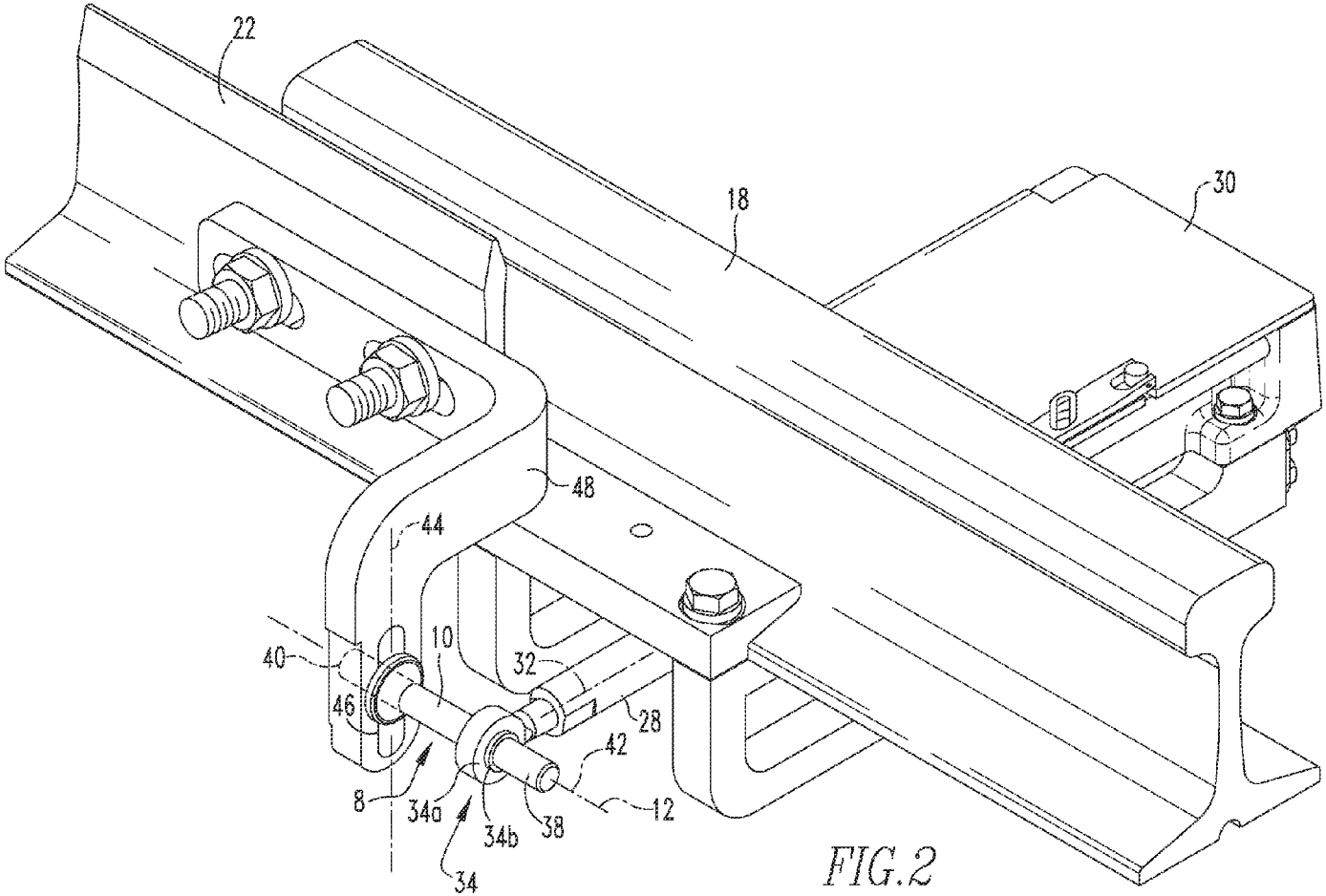
FIG. 2 is an isometric view of a portion of the railroad switch detection system of FIG. 1 showing a coupling mechanism and associated members.
Figure 3:
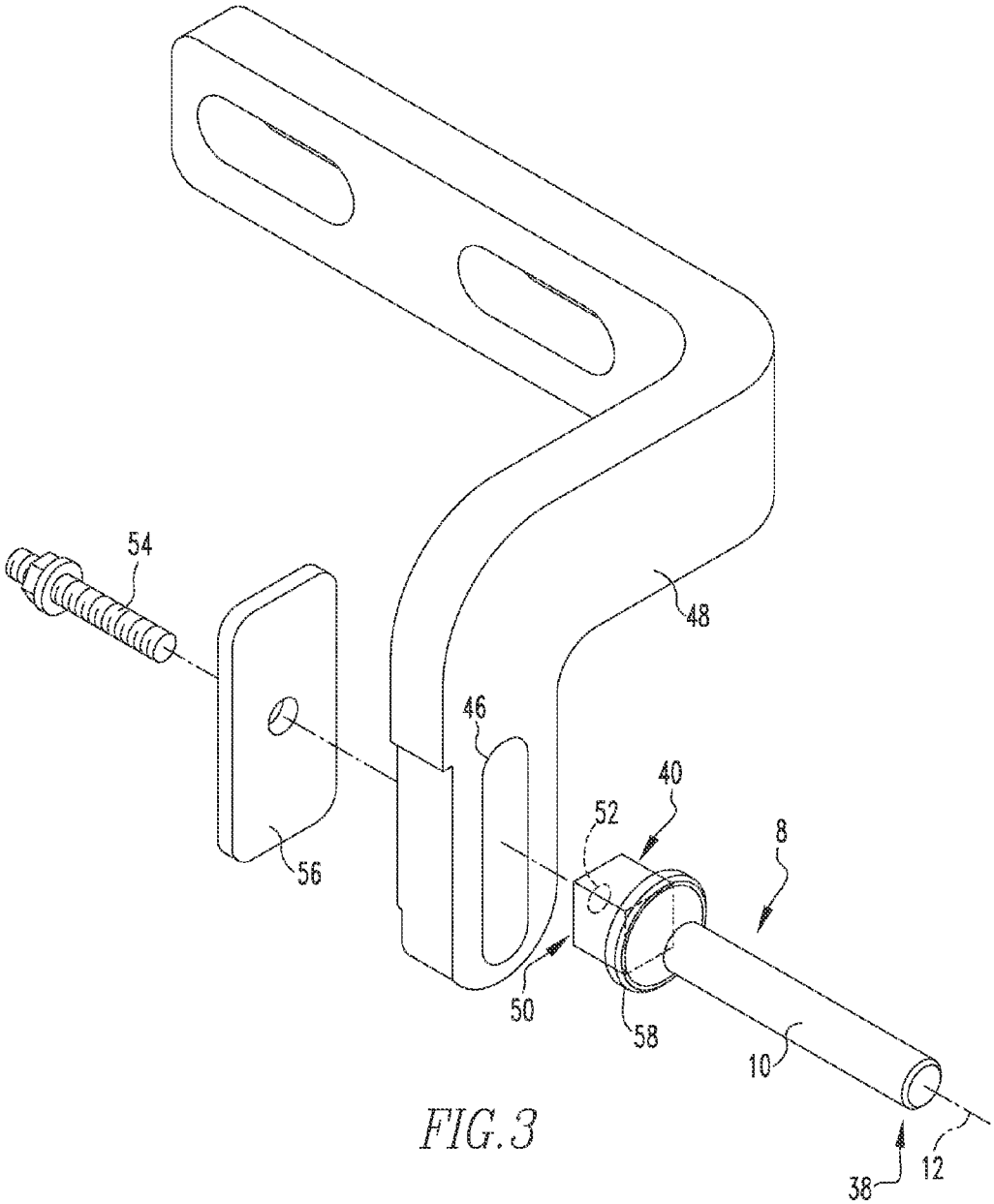
FIG. 3 is an exploded view of a portion of the view of FIG. 2 showing details of a coupling mechanism in accordance with an embodiment of the present invention.

Having thus described the overall arrangement of railroad switch detection system 4 a detailed description of coupling mechanism 8 will now be provided in conjunction with FIGS. 2 and 3. Referring to the exploded view of FIG. 3, coupling mechanism 8 includes a generally cylindrical body 10 disposed about a central longitudinal axis 12 and includes a first portion 38 and an opposite second portion 40. First portion 38 is structured to be slidably coupled to point detector bar 28. Preferably such slidable coupling is accomplished by first portion 38 being formed as a generally smooth cylindrical shaft portion that slidably engages the point detector bar 28 via ball and socket joint 34 (FIG. 2) or other suitable structure. Referring to FIG. 2, ball and socket joint 34, as the name implies, includes an outer, socket portion 34*a* that is adjustably coupled (preferably via a threaded member) to an end of point detector bar 28 and includes a generally spherical, smooth inner surface (not numbered). Ball and socket joint 34 further includes a generally spherical ball member 34*b*, disposed within the inner surface of socket portion 34*a* in a manner such that ball member 34*b* may rotate freely in all directions without noticeable restriction from socket member 34*a*. Ball member 34*b* includes an aperture (not numbered) through which first portion 38 of coupling mechanism 8 slidably engages and extends generally therethrough. As shown in FIG. 2, such slidable coupling allows for the first portion 38 of coupling mechanism 8 to slide relative to the point detector bar 28 generally along an axis 42, which generally coincides with the central longitudinal axis 12 of the generally cylindrical body 10 and is oriented generally perpendicular to axis 32, the axis along which the point detector bar 28 slides relative to point detector box 30. It is to be appreciated that the independent rotation of ball member 34*b* within socket portion 34*a* allows for axis 42 and 32 to also be oriented other than perpendicular without binding, which is beneficial as such non-perpendicular alignments can commonly occur at various points during operation of movable rails 22 and 24. It is also to be appreciated that the slidable coupling of the first portion 38 or coupling mechanism 8 with respect to the point detector bar 28 accommodates for axial movement (i.e., change of length) of movable rail 22 resulting from movement of the movable rail 22 during switching operations and/or due to fluctuations in temperature (which may cause movable rail 22 to expand or contract).

Second portion 40 of coupling mechanism 8 is structured to be slidably coupled to movable rail 22 such that second portion 40, and thus the entirety of coupling mechanism 8, is generally free to slide relative to movable rail 22 along axis 44, which is oriented generally perpendicular to axis 42, and thus conversely, movable rail 22 may freely move vertically with respect to coupling mechanism 8 (such as may commonly occur, for example, during passage of a train). In the example embodiment shown in FIGS. 1-3, such slidable coupling between the second portion 40 and movable rail 22 is accomplished via the interaction of second portion 40 with an elongated aperture 46 provided in a bracket 48 coupled to movable rail 22. It is to be appreciated that such an elongated aperture 46 could also be provided in or on the movable rail 22 without varying from the scope of the present invention. In a preferred embodiment of the invention, such as shown in FIG. 3, the second portion 40 comprises an engagement portion 50 of generally square or rectangular shape that is sized to slide within elongated aperture 46. Engagement portion 50 includes a threaded aperture 52 that is adapted to receive a bolt 54 disposed therein to loosely couple engagement portion 50 to bracket 48. As further shown in FIG. 3, a plate member 56 or other suitable member is preferably provided adjacent bolt 54 to assist in the slidable engagement between coupling mechanism 8 and bracket 48. As also shown in FIG. 3, an enlarged diameter portion 58 is provided adjacent second portion 50.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A mechanism for coupling a switch point to a point detector box having a point detector bar, the coupling mechanism comprising:

a first portion structured to be slidably coupled to the point detector bar; and a second portion structured to be slidably coupled to the switch point, wherein the first portion comprises a generally smooth cylindrical shaft portion disposed about a central longitudinal axis such that the first portion is structured to be readily translatable via sliding along the central longitudinal axis, and wherein the second portion comprises an engagement portion of a first width bounded by an adjacent portion having a greater width and wherein the second portion is structured to slidably engage an elongated aperture disposed on, in, or coupled to the switch point.

2. The mechanism of claim 1 wherein the shaft portion is structured to slidably engage a generally spherical ball member disposed within a socket coupled to the point detector bar such that the spherical ball member may slide along the shaft portion parallel to the central longitudinal axis.

3. The mechanism of claim 1 wherein the second portion includes a threaded aperture disposed about, and extending along the central longitudinal axis.

4. A detection system for detecting the position of a movable switch point of a railway, the detection system comprising:

a point detector box having a point detector bar; and a mechanism structured to couple the point detector bar to the movable switch point, the mechanism comprising:

a first portion slidably coupled to the point detector bar, and a second portion structured to be slidably coupled to the movable switch point.

5. The detection system of claim 4 wherein the first portion of the mechanism is structured to slide along a first axis and the second portion of the mechanism is structured to slide along a second axis, the second axis oriented generally perpendicular to the first axis.

6. The detection system of claim 5 wherein the point detector bar moves relative to the point detector box generally along a third axis and wherein the third axis is oriented generally perpendicular to the first axis.

7. The detection system of claim 5 wherein the first and second portions of the mechanism are portions of a generally cylindrical body disposed about a central longitudinal axis and wherein the central longitudinal axis coincides with the first axis.

8. The detection system of claim 7 wherein the second portion of the mechanism comprises an engagement portion having a first diameter bounded by an adjacent portion having a second diameter greater than the first diameter and wherein the second portion of the mechanism is structured to slidably engage an elongated aperture disposed on, in, or coupled to the switch point.

9. The detection system of claim 4 wherein the point detector bar comprises a socket having a generally spherical shaped ball member disposed therein and wherein the first portion of the mechanism comprises a generally smooth cylindrical shaft portion slidably coupled to the ball member.

10. The detection system of claim 4 wherein the first portion of the mechanism is disposed at or about a first end of a generally cylindrical body and the second portion of the mechanism is disposed at or about a second end of the generally cylindrical body.

11. A railway switching system comprising:

a movable switch point; and a detection system comprising:

a point detector box having a point detector bar; and a mechanism coupling the point detector bar of the point detector box to the movable switch point, the mechanism comprising:

a first portion slidably coupled to the point detector bar, and a second portion slidably coupled to the movable switch point.

12. The railway switching system of claim 11 wherein the first portion of the mechanism is structured to slide along a first axis and the second portion of the mechanism is structured to slide along a second axis, the second axis oriented generally perpendicular to the first axis.

13. The railway switching system of claim 12 wherein the point detector bar moves relative to the point detector box generally along a third axis and wherein the third axis is oriented generally perpendicular to the first axis.

14. The railway switching system of claim 12 wherein the first and second portions of the mechanism are portions of a generally cylindrical body disposed about a central longitudinal axis and wherein the central longitudinal axis coincides with the first axis.

15. The railway switching system of claim 14 wherein the second portion of the mechanism comprises an engagement portion having a first diameter bounded by an adjacent portion having a second diameter greater than the first diameter and wherein the second portion of the mechanism slidably engages an elongated aperture disposed on, in, or coupled to the switch point.

16. The railway switching system of claim 11 wherein the point detector bar comprises a socket having a generally spherical ball member disposed therein and wherein the first portion of the mechanism comprises a generally smooth cylindrical shaft portion slidably coupled to the ball member.

* * * * *